US010879612B2

(12) United States Patent
Coupez

(10) Patent No.: US 10,879,612 B2
(45) **Date of Patent: *Dec. 29, 2020**

(54) CONFIGURABLE MULTIBAND ANTENNA ARRANGEMENT AND DESIGN METHOD THEREOF

(71) Applicant: INSTITUT MINES-TELECOM / TELECOM BRETAGNE, Brest (FR)

(72) Inventor: Jean-Philippe Coupez, Brest (FR)

(73) Assignee: INSTITUT MINES-TELECOM/TELECOM BRETAGNE, Brest (FR)

( * ) Notice: Subject to any disclaimer, the term of this patent is extended or adjusted under 35 U.S.C. 154(b) by 261 days.

This patent is subject to a terminal disclaimer.

(21) Appl. No.: 15/674,173

(22) Filed: Aug. 10, 2017

(65) Prior Publication Data

US 2018/0053999 A1 Feb. 22, 2018

(30) Foreign Application Priority Data

Aug. 16, 2016 (EP) ..... 16306059

(51) Int. Cl.
*H01Q 9/04* (2006.01)
*H01Q 9/16* (2006.01)
(Continued)

(52) U.S. Cl.
CPC ..... *H01Q 9/0442* (2013.01); *H01Q 1/36* (2013.01); *H01Q 5/342* (2015.01); *H01Q 9/16* (2013.01);
(Continued)

(58) Field of Classification Search
CPC ..... H01Q 5/371; H01Q 9/42; H01Q 9/43; H01Q 9/0407; H01Q 9/0442
See application file for complete search history.

(56) References Cited

U.S. PATENT DOCUMENTS

2002/0140615 A1 10/2002 Carles et al.
2004/0017315 A1 1/2004 Fang et al.
2016/0156095 A1 6/2016 Coupez

FOREIGN PATENT DOCUMENTS

DE 388 035 C 1/1924
EP 1 122 812 A2 8/2001
(Continued)

OTHER PUBLICATIONS

European Search Report for 16306059.3 dated Mar. 3, 2017.

*Primary Examiner* — Robert Karacsony
(74) *Attorney, Agent, or Firm* — Meagher Emanuel Laks Goldberg & Liao, LLP

(57) ABSTRACT

The invention discloses an antenna arrangement and a method of designing the same, the antenna arrangement being tuned to radiate in a plurality of bands. The antenna arrangement comprises a first conductive element which has a compact linear 2D or 3D form factor. It also comprises leaves attached to the first conductive element, the position, dimension, form factor and orientation of which are defined based on their impact on frequency shifts of the fundamental and harmonic modes, so that the antenna arrangement radiates at a plurality of predefined frequencies. The design method uses maps of hot areas where the sensitivity to the parameters defined for the leaves is maximal. Advantageously, the design method is performed in a manner which uses an orthogonality of the impacts of the parameters of the leaves vis-à-vis the different radiating modes. The antenna arrangement is compact and well adapted to applications to the IoT and consumer communication devices.

15 Claims, 14 Drawing Sheets

(51) Int. Cl.

| | |
|---|---|
| ***H01Q 1/36*** | (2006.01) |
| ***H01Q 9/30*** | (2006.01) |
| ***H01Q 5/342*** | (2015.01) |
| ***H01Q 9/42*** | (2006.01) |

(52) U.S. Cl.
CPC ..... *H01Q 9/30* (2013.01); *H01Q 9/42* (2013.01); *H01Q 1/362* (2013.01)

(56) References Cited

FOREIGN PATENT DOCUMENTS

| | | | |
|---|---|---|---|
| EP | 1 750 323 | A1 | 2/2007 |
| EP | 2 323 217 | A1 | 5/2011 |
| WO | 200122528 | A1 | 3/2001 |
| WO | 03/034538 | A1 | 4/2003 |
| WO | 200334544 | A1 | 4/2003 |
| WO | 2015007746 | A1 | 1/2015 |

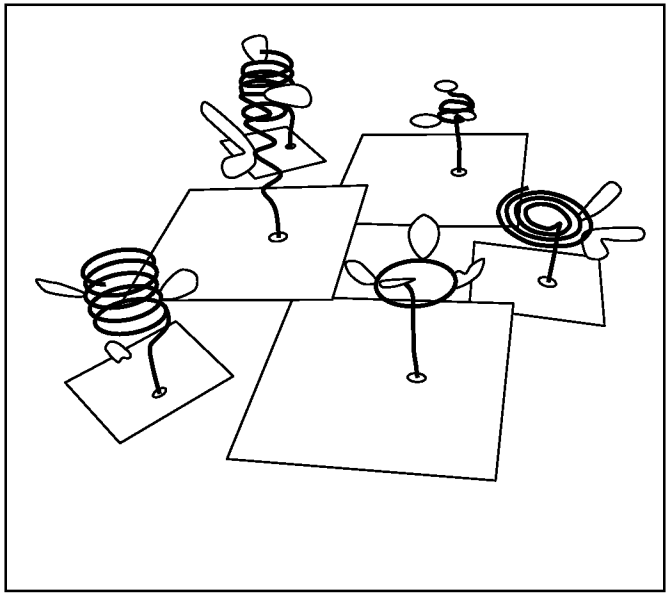
FIG.6
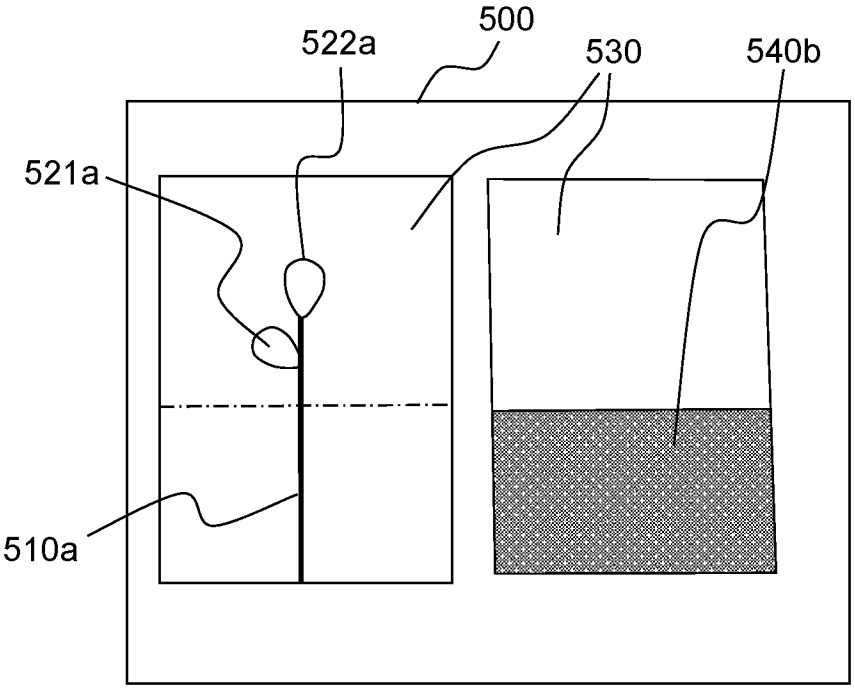
FIG.5b
FIG.5a

| %L \ f | $f_0$ | $f_1$ | $f_2$ | $f_3$ | $f_0$ | $f_1$ | $f_2$ | $f_3$ |
|---|---|---|---|---|---|---|---|---|
| 100 | ⊕ | ⊕ | ⊕ | ⊕ | 6 | 6 | 6 | 6 |
| 95 | ⊕ | ⊕ | ⊕ | ⊕ | 6 | 6 | 6 | 6 |
| 90 | ⊕ | ⊕ | ⊕○ | ○ | 6 | 6 | 5 | 3 |
| 85 | ⊕ | ⊕ | ○● | ● | 6 | 6 | 2 | 0 |
| 80 | ⊕ | ○ | ● | ○⊕ | 6 | 3 | 0 | 4 |
| 75 | ⊕ | ○● | ○● | ⊕ | 6 | 2 | 2 | 6 |
| 70 | ⊕ | ● | ⊕○ | ⊕ | 6 | 0 | 5 | 6 |
| 65 | ⊕ | ● | ⊕ | ⊕ | 6 | 0 | 6 | 6 |
| 60 | ⊕ | ●○ | ⊕ | ●○ | 6 | 1 | 6 | 1 |
| 55 | ⊕ | ○ | ⊕ | ● | 6 | 3 | 6 | 0 |
| 50 | ⊕ | ⊕ | ⊕○ | ⊕○ | 6 | 6 | 5 | 5 |
| 45 | ○ | ⊕ | ○● | ⊕ | 3 | 6 | 2 | 6 |
| 40 | ○ | ⊕ | ● | ⊕ | 3 | 6 | 0 | 6 |
| 35 | ○ | ⊕ | ○● | ○⊕ | 3 | 6 | 2 | 4 |
| 30 | ○ | ⊕ | ⊕○ | ● | 3 | 6 | 5 | 0 |
| 25 | ○ | ⊕ | ⊕ | ○● | 3 | 6 | 6 | 2 |
| 20 | ● | ⊕ | ⊕ | ⊕ | 0 | 6 | 6 | 6 |
| 15 | ● | ○⊕ | ⊕ | ⊕ | 0 | 4 | 6 | 6 |
| 10 | ● | ○ | ⊕○ | ⊕ | 0 | 3 | 5 | 6 |
| 5 | ● | ● | ○● | ○ | 0 | 0 | 2 | 3 |
| 0 | ● | ● | ● | ● | 0 | 0 | 0 | 0 |

14100 14110 14121 14122 14123 14200 14300

⊕=6 ⊕○=5 ○⊕=4 ○=3

○●=2 ●○=1 ●=0

FIG.14

| | | | | | | | |
|---|---|---|---|---|---|---|---|
| Adding a leaf at | 100%L | ⇒ | Impact on | $f_0$ | $f_1$ | $f_2$ | $f_3$ |
| // | 85%L | | | $f_0$ | $f_1$ | | |
| // | 75%L | | | $f_0$ | | | $f_3$ |
| // | 60%L | | | $f_0$ | | $f_2$ | |
| // | 40%L | | | | $f_1$ | | $f_3$ |
| // | 25%L | | | | $f_1$ | $f_2$ | |
| // | 20%L | | | | $f_1$ | $f_2$ | $f_3$ |
| // | 12,5%L | | | | | $f_2$ | $f_3$ |

CONFIGURABLE MULTIBAND ANTENNA ARRANGEMENT AND DESIGN METHOD THEREOF

FIELD OF THE INVENTION

The invention relates to antenna arrangements having a plurality of frequency modes in the VHF, UHF, S, C, X or higher frequency bands. More precisely, an antenna arrangement according to the invention may be designed and tuned in a simple manner to transmit/receive (T/R) radiofrequency signals at a plurality of frequencies, notably in the microwave or VHF/UHF domains, with compact form factors.

BACKGROUND

Terminals or smartphones on board aircraft, ships, trains, trucks, cars, or carried by pedestrians need to be connected while on the move. These devices need short and very long range communication capabilities for voice and data at a high-throughput and a low power budget, including to watch or listen to multimedia content (video or audio), or participate in interactive games. All kinds of objects on-board vehicles or located in a manufacturing plant, an office, a warehouse, a storage facility, retail establishments, hospitals, sporting venues, or a home are connected to the Internet of Things (IoT): tags to locate and identify objects in an inventory or to keep people in or out of a restricted area; devices to monitor physical activity or health parameters of their users; sensors to capture environmental parameters (concentration of pollutants; hygrometry; wind speed, etc.); actuators to remotely control and command all kinds of appliances, or more generally, any type of electronic device that could be part of a command, control, communication and intelligence system, the system being for instance programmed to capture/process signals/data, transmit the same to another electronic device, or a server, process the data using processing logic implementing artificial intelligence or knowledge based reasoning and return information or activate commands to be implemented by actuators.

RF communications are more versatile than fixed-line communications for connecting these types of objects or platforms. As a consequence, radiofrequency T/R modules are and will be more and more pervasive in professional and consumer applications. A plurality of T/R modules may be implemented on the same device. By way of example, a smartphone typically includes a cellular communications T/R module, a Wi-Fi/Bluetooth T/R module, a receiver of satellite positioning signals (from a Global Navigation Satellite System or GNSS). WiFi, Bluetooth and 3 or 4G cellular communications are in the 2.5 GHz frequency band (S-band). GNSS receivers typically operate in the 1.5 GHz frequency band (L-band). RadioFrequency IDentification (RFID) tags operate in the 900 MHz frequency band (UHF) or lower. Near Field Communication (NFC) tags operate in the 13 MHz frequency band (HF) at a very short distance (about 10 cm).

It seems that a good compromise for IoT connections lies in VHF or UHF bands (30-300 MHz and 300 MHz to 3 GHz) to get sufficient available bandwidth and range, a good resilience to multipath reflections as well as a low-power budget.

A problem to be solved for the design of T/R modules at these frequency bands is to have antennas which are compact enough to fit in the form factor of a connected object. A traditional omnidirectional antenna of a monopole type, adapted for VHF bands, has a length between 25 cm and 2.5 m ($\lambda/4$). A solution to this problem is notably provided by PCT application published under n° WO2015007746, which has the same inventor and is co-assigned to the applicant of this application. This application discloses an antenna arrangement of a bung type, where a plurality of antenna elements are combined so that the ratio between the largest dimension of the arrangement and the wavelength may be much lower than a tenth of a wavelength, even lower than a twentieth or, in some embodiments than a fiftieth of a wavelength. To achieve such a result, the antenna element which controls the fundamental mode of the antenna is wound up in a 3D form factor, such as, for example, a helicoid so that its outside dimensions are reduced relative to its length.

But there is also a need for the connected devices to be compatible with terminals which communicate using WiFi or Bluetooth frequency bands and protocols. In this use case, some stages of the T/R module have to be compatible with both VHF and S bands. If a GNSS receiver is added, a T/R capacity in L band is also needed. This means that the antenna arrangements of such devices should be able to communicate simultaneously or successively in different frequency bands. Adding as many antennas as frequency bands is costly in terms of form factor, power budget and materials. This creates another challenging problem for the design of the antenna. Some solutions are disclosed for base station antennas by PCT applications published under n° WO200122528 and WO200334544. But these solutions do not operate in VHF bands and do not provide arrangements which would be compact enough in these bands.

It is therefore an object of the invention to provide an antenna arrangement that is compact enough to fit in a small form factor and that can operate, for example, from VHF bands up to the S or C bands.

SUMMARY OF THE INVENTION

The invention fulfils this need by providing an antenna arrangement comprising an antenna element tuned to a lower frequency of a fundamental mode and additional elements whose position, form factor, dimension and orientation are determined to optimize the conditions of reception of selected harmonics of this fundamental mode.

According to one of its aspects, the invention discloses an antenna arrangement comprising: a first conductive element configured to radiate above a defined frequency of electromagnetic radiation; one or more additional conductive elements located at or near one or more positions defined as a function of positions of nodes of current of electromagnetic radiation of selected harmonics of the electromagnetic radiation.

Advantageously, a distance of the one or more positions in relation to the positions of nodes is defined based on an influence of said one or more additional conductive elements on values of the radiated frequencies of the electromagnetic radiation.

Advantageously, frequency shifts imparted by the additional conductive elements define a set of predefined radiation frequencies for the antenna arrangement.

Advantageously, one or more of a number, a first dimension, a form factor, or an orientation of the one or more additional conductive elements are defined based on a desired impact on a frequency shift of one or more of a fundamental mode or a higher order mode of electromagnetic radiation.

Advantageously, the one or more of a number, a first dimension, a form factor, or an orientation of the one or more additional conductive elements are further defined as a function of a desired impact on one or more of an antenna arrangement impedance, an antenna arrangement matching level or a bandwidth of the electromagnetic radiation.

Advantageously, the first conductive element is a metallic ribbon and/or a metallic wire.

Advantageously, the first conductive element has one of a 2D or 3D compact form factor.

Advantageously, the antenna arrangement of the invention is deposited by a metallization process on a non-conductive substrate layered with one of a polymer, a ceramic or a paper substrate.

Advantageously, the antenna arrangement of the invention is tuned to radiate in two or more frequency bands, comprising one or more of an ISM band, a WIFi band, a Bluetooth band, a 3G band, an LTE band and a 5G band.

Advantageously, the first conductive element is a monopole or a dipole antenna.

The invention also provides a design method of such an antenna arrangement.

According to another of its aspects, the invention also discloses a method of designing an antenna arrangement comprising: defining a geometry of a first conductive element to radiate above a defined frequency of electromagnetic radiation; locating one or more additional conductive elements at or near one or more positions defined as a function of positions of nodes of current of electromagnetic radiation of selected harmonics of the electromagnetic radiation.

Advantageously, locating the one or more additional conductive elements at or near one or more the defined positions is performed by starting from a fundamental mode and iterating in increasing order of the harmonics.

Advantageously, locating the one or more additional conductive elements at or near one or more the defined positions is performed based on a map of one or more of hot areas, tepid areas or cold areas by selecting positions which impact the less on modes which have already been tuned.

Advantageously, the method of the invention further comprises defining one or more of a number, a first dimension, a form factor, or an orientation of the one or more additional conductive elements based on a desired impact on a frequency shift of one or more of a fundamental mode or a higher order mode of electromagnetic radiation.

Advantageously, defining one or more of a number, a first dimension, a form factor, or an orientation of the one or more additional conductive elements is further based on a desired impact on one or more of an antenna arrangement impedance, an antenna arrangement matching level or a bandwidth of the electromagnetic radiation.

The multi-frequency antenna arrangement of the invention may be used, either in alternate mode or in simultaneous mode on a plurality of aggregated frequencies, thus increasing significantly the bandwidth resources.

The antenna arrangement of the invention may be compact, notably for the lowest frequency used, which allows its integration in small volumes.

The antenna arrangement of the invention is simple to design, notably when tuning radiating frequencies to desired values, taking into account the impact of the environment of the antenna arrangement, notably the ground plane, the position of the main trunk of the antenna and elements of the environment that have an electromagnetic impact on its electrical performance.

The antenna arrangement of the invention is easy to manufacture and thus has a very low cost.

BRIEF DESCRIPTION OF THE DRAWINGS

The invention and its advantages will be better understood upon reading the following detailed description of a particular embodiment, given purely by way of non-limiting example, this description being made with reference to the accompanying drawings in which:

FIGS. 5*a* and 5*b* display two faces of an example of a 2D antenna according to an embodiment of the invention;

FIG. 6 displays a number of examples of 3D antennas according to different embodiments of the invention;

FIG. 14 represents a table of electric sensitivities along the antenna in the fundamental mode and the $1^{st}$ to $3^{rd}$ higher order modes for an antenna arrangement according to the invention;

DETAILED DESCRIPTION

Figure 1:
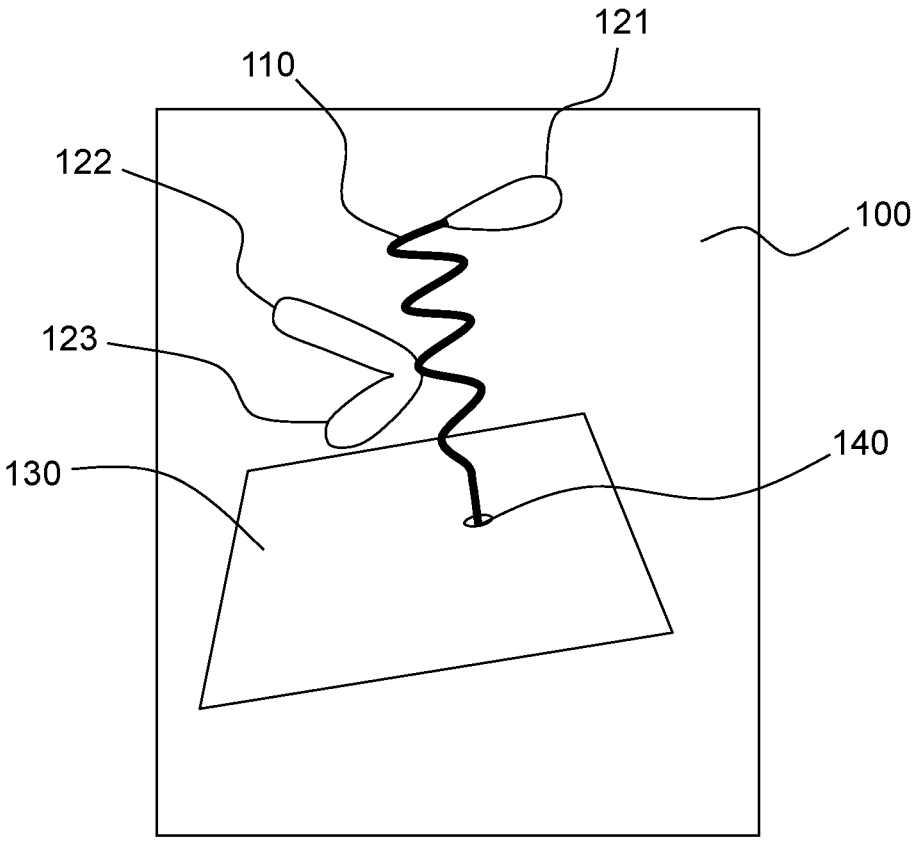
FIG. 1 represents an antenna arrangement according to an embodiment of the invention.

FIG. 1 represents an antenna arrangement according to an embodiment of the invention.

The antenna arrangement 100 is a monopole antenna with an omnidirectional radiating pattern.

The structure of the antenna arrangement 100 according to embodiments of the invention is analogous to a compact tree structure that in some aspects resembles the structure of a bonsai. The dimensions of this arrangement are selected so that the antenna is fit to operate in the ISM (Industrial, Scientific, Medical), VHF and UHF bands. The tree comprises a trunk 110, leaves 121, 122 and 123. The tree is planted on a ground plane 130.

The trunk 110 is formed of a conductive material, metallic wire or ribbon, with a deployed length L which is defined as a function of the desired radiating frequency of the fundamental mode as explained further down in the description. The trunk may be inscribed in a plane. In some embodiments described in relation to FIGS. 5*a*, 5*b* and 7, the plane in which the trunk is inscribed may be parallel to the ground plane, or may be inscribed in the ground plane in a solution where the antenna and the ground plane are designed as a coplanar arrangement. In such an arrangement, the antenna may be engraved on a face of the substrate and the ground plane may be engraved on the backplane of the substrate. In other embodiments like the one depicted on FIG. 1, the plane in which the trunk is inscribed is perpendicular to the ground plane. The trunk may alternatively be inscribed in a non-plane surface or a volume structure, as in the case of the embodiments of the invention which will be described in relation to FIGS. 6 and 8. Such a form factor is advantageous to increase the compactness of an antenna arrangement of a given length L.

The leaves 121, 122, 123 are also formed of a metal and mechanically and electrically connected to the trunk at defined points, as discussed further down in the description. The leaves may be seen as structures extending the length of the antenna of a defined amount in defined directions. The leaves may thus have different positions, form factors, dimensions and orientations in space. They may be inscribed together in a same plane or different surface or not. They may be coplanar with the trunk or not. The selected positions, form factors dimensions and orientations will affect the variation in radiating frequencies (i.e. fundamental and higher order modes) imparted to the base frequencies defined by the length of the trunk.

The different radiating modes are basically defined by the length of the radiating pole element:

- The fundamental mode is defined by a length L or $L_0$ of the radiating element which is equal to $\lambda/4$;
- The $1^{st}$ higher order mode is defined by a $L_1$ of the radiating element which is equal to $3\lambda/4$ (third harmonic);
- The $2^{nd}$ higher order mode is defined by a $L_2$ of the radiating element which is equal to $5\lambda/4$ (fifth harmonic);
- The $3^{rd}$ higher order mode is defined by a $L_3$ of the radiating element which is equal to $7\lambda/4$ (seventh harmonic).

The ground plane 130 is the metallic backplane of a PCB structure which comprises the excitation circuits which feed the RF signal to the trunk at their point of mechanical and electrical connection 140.

FIGS. 2*a*, 2*b*, 2*c* and 2*d* respectively illustrate a monopole antenna of a classical geometry, with the current distribution in its fundamental mode, the third and fifth harmonics according to the prior art.

Figure 2A:
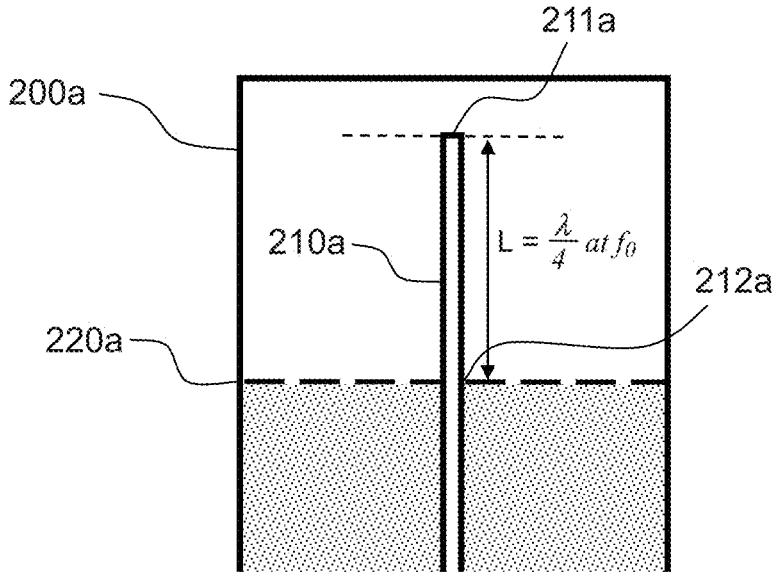
FIGS. 2*a*, 2*b*, 2*c* and 2*d* respectively illustrate a monopole antenna of a classical geometry with the current distribution in its fundamental mode, third and fifth harmonics according to the prior art.
Figure 2B:
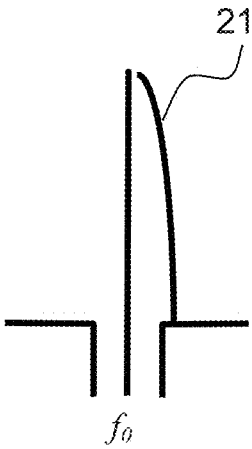

FIG. 2*a* displays a classical monopole antenna arrangement 200*a*. Its radiating frequency will be defined by the length L between the upper end 211*a* of the pole 210*a* and its intersection 212*a* with the ground plane 220*a*. When the radiating frequency has to be set to a $f_0$ value, the length L of the pole will have to be equal to $\lambda/4$ with $\lambda=c/f_0$, where c is the speed of light in vacuum. FIG. 2*b* represents on a curve 210*b*, the distribution of current in the pole at the fundamental mode.

Figure 2C:
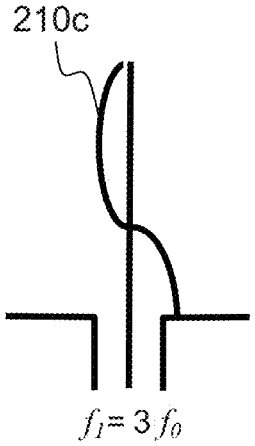
Figure 2D:
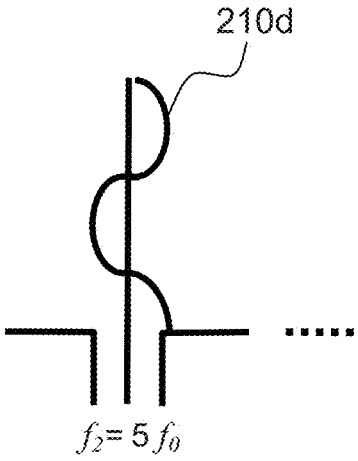

It is known that an antenna radiating at frequency $f_0$ will also transmit radiation at the harmonics frequency having an odd coefficient, 3, 5, 7, etc. FIG. 2*c* represents on a curve 210*c* the distribution in the pole of the current carried at the third harmonic 3 $f_0$. Likewise, FIG. 2*d* represents on a curve 210*d* the distribution in the pole of the current carried at the fifth harmonic 5 $f_0$.

It is therefore a principle of the invention to use the power transmitted by carriers modulated by each carrier generator, using the different resonating frequencies of the antenna arrangement.

According to the invention, as will be explained in a more detailed manner in the rest of the description, the multi-frequency features of the antenna arrangement of the invention rely on a first adjustment of the length L of the wire/ribbon trunk to the lowest carrier frequency which is desired, and then using the higher order resonance frequencies provided by the pole.

Figure 3:
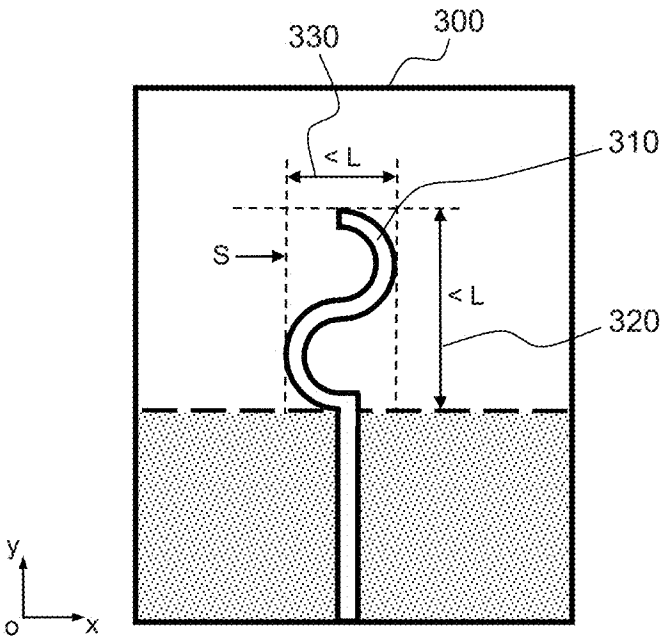
FIG. 3 illustrates a compacted monopole antenna according to the prior art.

FIG. 3 illustrates a compacted monopole antenna according to the prior art.

According to embodiments of prior art disclosures, such as those disclosed by PCT application published under n° WO2015007746 already cited, it is possible to compact the form factor of the pole by folding it, either in a plane, a non-planar surface or a volume as discussed earlier in relation to FIG. 1.

According to an embodiment of an antenna arrangement 300 displayed on FIG. 3, the pole 310 is given a sinusoidal form, with a vertical dimension 320 (along axis Y) and a horizontal dimension 330 (along axis X) which are both lower than the length L which is adapted to the fundamental frequency $f_0$ as determined before.

This antenna still has a multimode radiating behaviour, but the harmonics may be shifted in relation to the harmonics of a linear pole displayed on FIGS. 2*c* and 2*d* which were commented upon earlier. Generally speaking, the shift is towards higher frequencies. Theses frequencies depend upon the form factor of the pole, but cannot be easily controlled. It is therefore difficult, in most cases, to tune such an antenna assembly to preset frequency values.

It is therefore an object of the invention is to provide a method and a device to control precisely the harmonic frequencies of a folded pole as it will be now explained.

Figure 4:
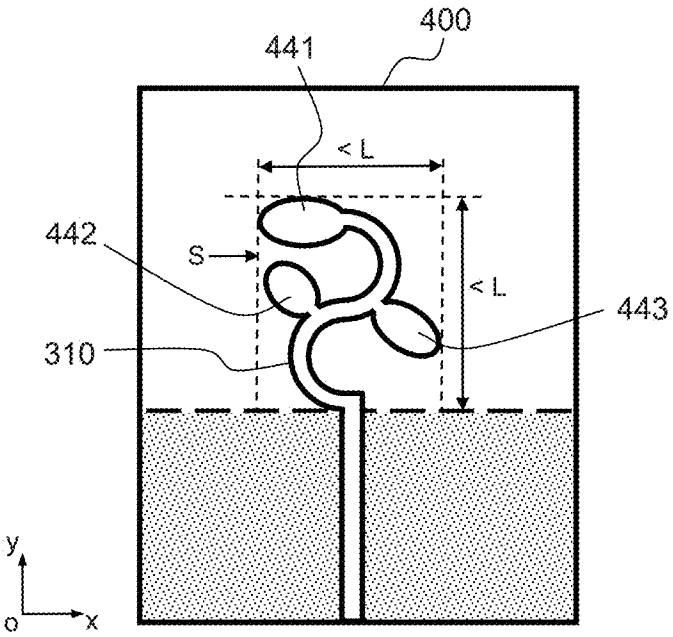
FIG. 4 illustrates a compacted monopole antenna having leaves in an embodiment of the invention.

FIG. 4 illustrates a compacted monopole antenna having leaves in an embodiment of the invention.

It has been determined experimentally by the inventor that, along the pole, the correlation between the displacement of a small perturbation of a spot on the pole and the shift in frequency generated by this displacement varies significantly. The spots where this correlation is the highest are further designated in this description as "Hot Spots". The spots where this correlation is the lowest are further designated in this description as "Cold Spots". According to the invention, by superimposing the various Hot Spots and Cold Spots for each radiating frequency (fundamental and some harmonics) along the pole, it is possible to determine a map of the same. It has also been determined by the inventor that some Hot Spots are sensitive to all frequencies. For instance, it is the case of the Open Circuit spot (OC) of the folded pole, which is located at top end extremity of the folded pole, at the position of leaf 441. It has also been determined that some Hot Spots are only sensitive to some frequencies. This advantageous property is used, according to the invention, to precisely tune the configuration of the antenna arrangement to the desired frequencies by adding leaves to the folded trunk or pole or moving or removing existing leaves that would have been ill-positioned or the position of which should be changed to obtain a change in the desired frequency (change of operating frequency rendered necessary by a change of standard, for instance).

The starting point of the tuning according to the invention is a folded monopole. The frequencies (fundamental and useful harmonics) are selected with values higher than the desired frequencies, or in some embodiments, equal to one of the desired frequencies. When one of the modes has a radiating frequency which is equal to a desired frequency, no leaf should be added to modify this radiating frequency. For the modes which have a radiating frequency that is different from a desired frequency, one or more leaves may be added at a selected position, with a form factor and dimensions which allow to decrease the radiating frequency at this mode. The higher the difference between the initial radiating frequency and the desired frequency, the larger the characteristic form factor and main dimensions of the added leaf will have to be, which is generally not desired. Some rules to define the relationship between the target shift in radiating frequency and the form factor and dimensions of the added leaf will be explained further down in the description. Therefore, according to the design method of the invention, leaves are to be added at selected spots on the pole to tune each frequency. Advantageously, the tuning is performed for each frequency independently from the other frequencies. This may be achieved by adding leaves on the Hot Spots which are (only) hot for the frequencies which are to be tuned and cold for the other frequencies. This method uses a kind of orthogonality between the tuning properties of the different frequencies. This method provides a simple and efficient manner of achieving the complete tuning of the antenna arrangement. According to other embodiments of the invention, it is also possible to tune a plurality of frequencies at the same time, or possibly all the frequencies at the same time. This may provide a solution with a lower number of leaves, at the expense of a longer design phase.

FIG. 4 displays an example of an antenna arrangement 400 designed according to the method described above. Leaves 441, 442, 443 have been added to the trunk 310 at spots determined as described above.

FIGS. 5*a* and 5*b* display two faces of an example of a 2D antenna according to an embodiment of the invention.

The process to manufacture 2D antenna arrangements according to the invention may be quite simple and its cost may be quite low.

As an example, FIG. 5*a* displays the front face 510*a* of a planar antenna 500 according to an embodiment of the invention which may be manufactured by a printing process on a paper substrate, but the substrate may also be rigid or flexible, as is the case for a polymer or ceramic substrate. The substrate may also be in any other non-conductive material. The active elements of the antenna, i.e. the trunk 510*a* and the leaves 521*a* and 522*a* are printed on the front face of the substrate 530. Printing may be performed by prior metallisation and further etching of the substrate, or by selective printing of the substrate.

The ground plane 540*b* is implanted on the back face of the substrate by the same process.

FIG. 6 displays a number of examples of 3D antennas according to different embodiments of the invention.

In these examples of 3D antennas, the manufacturing process is based on a metallic wire or ribbon which is formed to the desired form factor. The form factor is determined according to rules which are discussed further down in the description in relation to FIGS. 10*a*, 10*b* and 10*c*. The conducting leaves (which may be metallic) are cut with form factors and dimensions according to rules which are discussed further down in the description in relation to FIGS. 11*a* to 11*h*. They are then welded, or added by another process, at selected spots on the pole, with an orientation which is determined in azimuth and elevation angles as explained below.

Other manufacturing processes such as an additive process or 3D printing may be used to manufacture the antennas. In addition, 2D manufacturing on flexible substrate may also be conducted to reach a 3D realization.

The antenna arrangements displayed on FIG. 6 demonstrate that a significant variety of form factors of the trunk, number, positions, form factors, dimensions and orientations of the leaves can be achieved. This allows an adaptation to a large number of applications, using different frequency bands with a variety of bandwidths. For instance, some of the antenna arrangements of the invention may be used for communications within the office or the home, using a set-top box or a gateway. Also, IoT applications may benefit from the advantages procured by the antenna arrangements of the invention, notably their multi-frequency capability, their small form factor and their low cost. For instance, such antennas can be used to capture data from gas, water or electricity consumption metering devices. They may also be used to capture data from any kind of sensors, e.g. motion sensors to monitor physical activity or status.

For some applications, it may be advantageous to be able to adjust the bandwidth which is available around each radiating frequency. According to the invention, each added leaf plays the role of a first order passive filter. Such a filter is not easy to tune to define a specific bandwidth. It is possible to define a higher order filter by replacing a single leaf of defined form factor, dimensions and orientations by a branch having a single leaf or multiple leaves.

Figure 7:
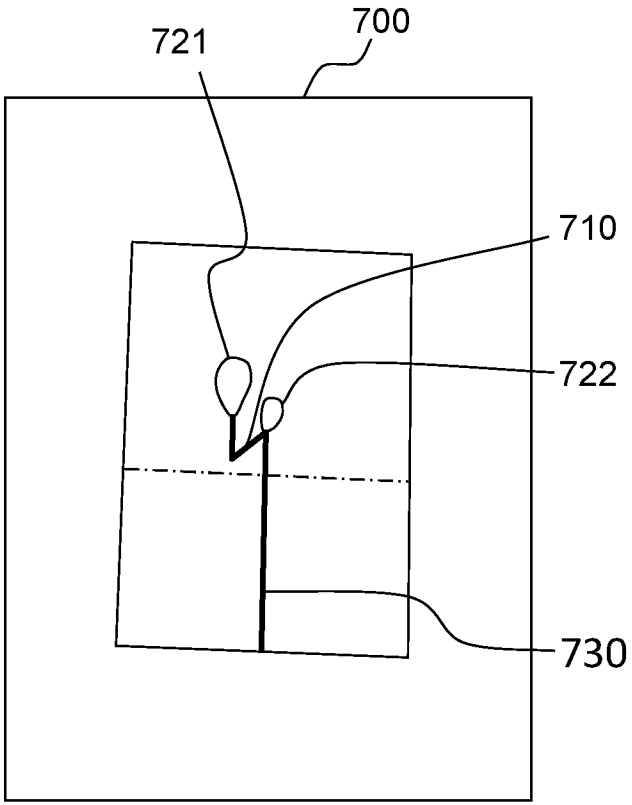
FIG. 7 represents a specific 2D antenna according to an embodiment of the invention.

FIG. 7 displays a specific 2D antenna according to an embodiment of the invention.

The antenna arrangement 700 of FIG. 7 comprises a trunk 710, which is a simple central ribbon, and two leaves 721 and 722, the first one 721 at the top end of the trunk and the second one 722 located in the lower part of the trunk. This radiating element is excited by a micro-ribbon line 730, which has a characteristic impedance of 500 hms. This antenna arrangement is designed to operate in two WiFi bands (2.45 GHz and 5 GHz).

Figure 8:
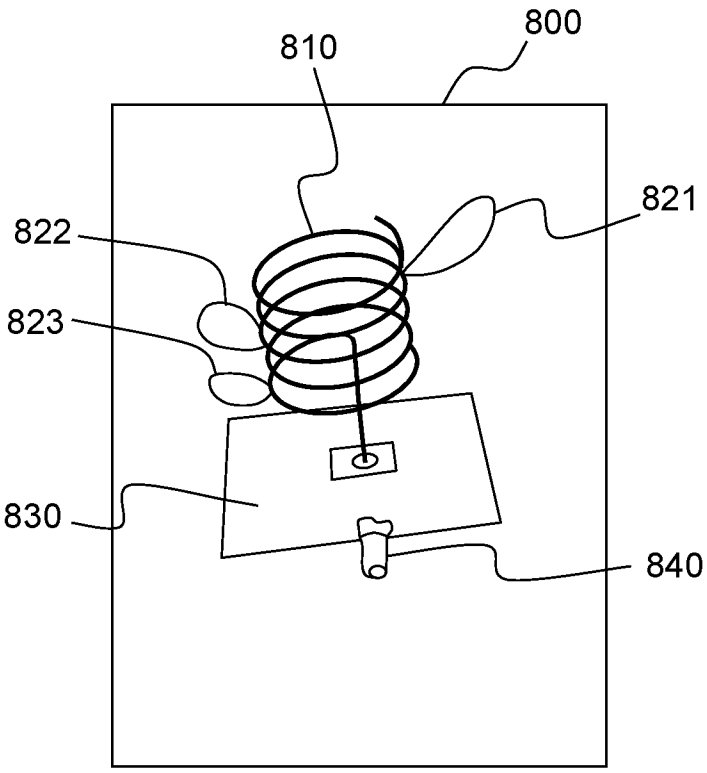
FIG. 8 represents a specific 3D antenna according to an embodiment of the invention.

FIG. 8 displays a specific 3D antenna according to an embodiment of the invention.

The antenna arrangement 800 of FIG. 8 comprises a trunk 810, which is a metallic wire rolled as a spiral. The arrangement is tuned to four frequencies of the ISM VHF/UHF bands, 169 MHz, 433 MHz, 868 MHz and 2.45 GHz. Three leaves only 821, 822, 823 were needed to perform the tuning. The antenna is simply mounted on the backplane 830 of a PCB which is metallised to form the ground plane of the antenna arrangement. A hole in the backplane is provisioned to allow a direct connection to an excitation line 840 which has a characteristic impedance of 50 Ohms.

The dimensions of the antenna arrangement are very compact: they remain lower than $\lambda/25$, $\lambda$ being defined by the fundamental frequency of 169 MHz.

FIGS. 9*a*, 9*b*, 9*c* and 9*d* allow visualization of the positions of the hot and cold spots on an antenna in two radiating modes, according to some embodiments of the invention.

Figure 9A:
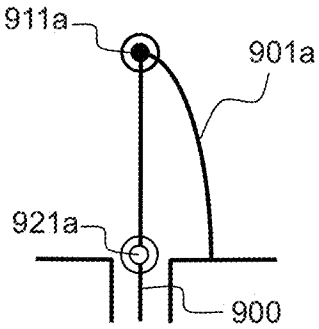
FIGS. 9*a*, 9*b*, 9*c* and 9*d* allow visualization of the positions of the hot and cold spots on an antenna in two radiating modes, according to some embodiments of the invention.
Figure 9B:
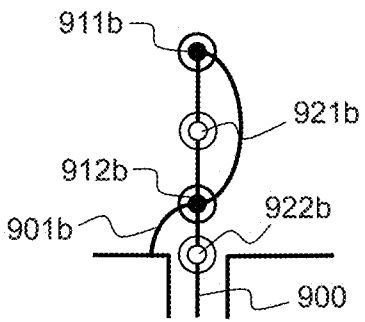

FIGS. 9*a* and 9*b* respectively show the positions on the pole 900 of the Hot Spots (911*a*, 911*b* and 912*b*) and the Cold Spots (921*a*, 921*b*, 922*b*) in the fundamental mode (FIG. 9*a*) and in the immediate higher order mode (FIG. 9*b*) corresponding to the third harmonic.

It can be seen that the Hot Spots 911*a*, 911*b*, 912*b* are located at the zero crossing points of the curves 901*a* and 901*b* that display the distribution of the current along the pole. Adding a leaf located at one of these Hot Spots will shift the radiating frequency to a lower value. Conversely, the Cold Spots 921*a*, 921*b*, 922*b* are located at the maximum values of the curves 901*a* and 901*b*. For the fundamental mode, there is only one Hot Spot and one Cold Spot. For the first higher order mode (third harmonic with k=1 in the order numbering 2k+1), there are 2 Hot Spots and two Cold Spots, i.e. there are k+1 Hot Spots and k+1 Cold Spots. Hot Spots and Cold Spots alternate along the pole. For k=1, the distance between a Hot Spot and the neighbour Cold Spot equals one quarter of the harmonics wavelength or one twelfth of the base wavelength or $\lambda/4(2k+1)$ or $L/(2k+1)$. The distance between a Hot Spot and the next closest Hot Spot equals two thirds of the length of the pole or one sixth of the base wavelength or $\lambda/2(2k+1)$ or $2L/(2k+1)$. These rules can be generalized for higher order modes k=2, 3, etc. corresponding to the $5^{th}$, $7^{th}$ harmonics, etc. The second order mode corresponding to the $5^{th}$ harmonics has 3 Hot Spots and 3 Cold Spots, two consecutive Hot Spots being spaced of 2L/5. The third order mode corresponding to the $7^{th}$ harmonics has 4 Hot Spots and 4 Cold Spots, two consecutive Hot Spots being spaced of 2L/7.

Figure 9C:
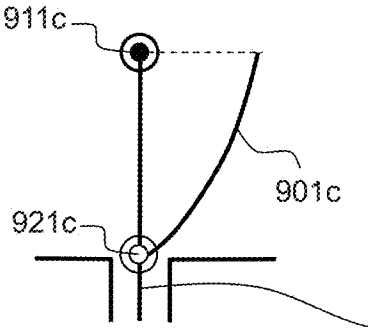
Figure 9D:
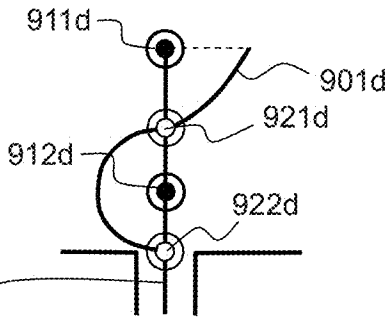

FIGS. 9*c* and 9*d* illustrate the same principles for the curves which are dual of the curves of respectively FIGS. 9*a* and 9*b*: they represent the evolution of the voltage along the pole 900 at the fundamental mode and the first order higher mode.

FIGS. 9*e*, 9*f*, 9*g*, 9*h*, 9*i* and 9*j* illustrate the electrical influence of an addition or moving of a leaf at a given spot of the trunk, in some embodiments of the invention.

Figure 9E:
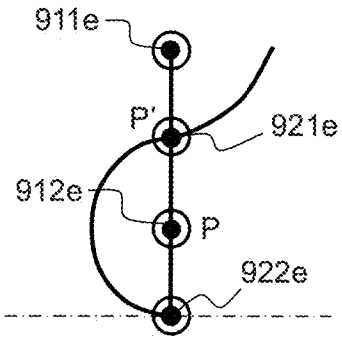
FIGS. 9*e*, 9*f*, 9*g*, 9*h*, 9*i* and 9*j* illustrate the electrical influence of an addition of a leaf at a given spot of the trunk, in some embodiments of the invention.

FIG. 9*e* represents the distribution of current along the pole in the first higher order mode. Spot P, 912*e*, on the figure is similar to point 912*b* on FIG. 9*b*, and spot P', 921*e*, is similar to point 921*b* on FIG. 9*b*. Point P is a point where the current equals zero (like at point 911*e*). Spot P' is a point where the current is maximal (like at point 922*e*).

Figure 9F:
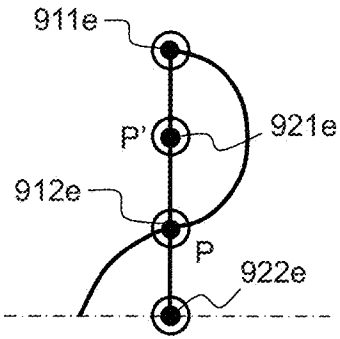

FIG. 9*f* represents the distribution of voltage along the pole in the first higher order mode and is a representation which is dual of FIG. 9*e*: spot P is located at a point where the voltage is maximal, and corresponds to an Open Circuit (or a quasi-infinite impedance). Spot P' is located at a point where the voltage is null, i.e. a Short Circuit (or a null impedance).

Figure 9G:
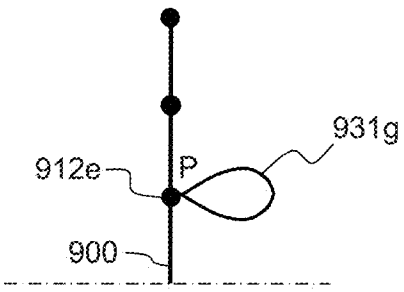
Figure 9H:
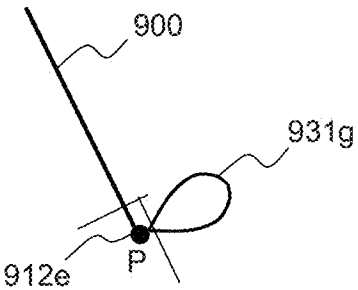
Figure 9J:
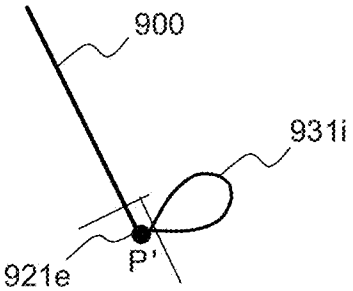

FIG. 9*g* illustrates a case where a leaf is positioned at spot P. The two equivalent circuits corresponding respectively to the pole 900 and the leaf 931*g* are mounted in parallel. As illustrated on FIG. 9*h*, from spot P, both the impedance of the rest of the pole and the impedance of the leaf 931*g* may be seen. The impedance Z of the rest of the pole being infinite (since the rest of the pole is an OC), only the impedance of the leaf may be seen from spot P).

Figure 9I:
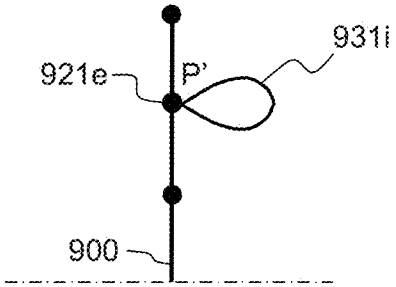

FIG. 9*i* illustrates a case where a leaf is positioned at spot P'. The two equivalent circuits corresponding respectively to the pole 900 and the leaf 931*i* are also mounted in parallel. As illustrated on FIG. 9*j*, from spot P', one sees both the impedance of the rest of the pole and the impedance of the leaf 931*i*. The impedance Z of the rest of the pole being null (the rest of the pole is a SC), only the impedance of the rest of the pole and not the impedance of the leaf will be seen from spot P'.

Thus, the impact of a leaf is maximum when positioned at spot P (which is a Hot Spot) and minimum when positioned at spot P' (which is a Cold Spot). In some embodiments, form factor or any other constraint may require placing a leaf a distance from spot P. As a result the impact of the leaf will not be maximum.

Figure 10C:
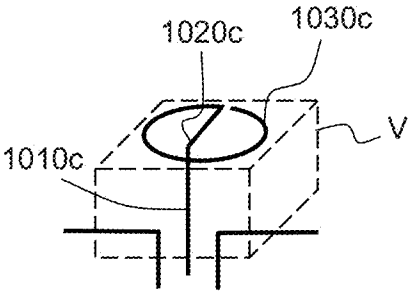
FIGS. 10*a*, 10*b* and 10*c* illustrate three different configurations of a monopole antenna arrangement having a same deployed length, according to some embodiments of the invention.
Figure 10B:
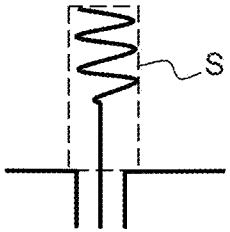
Figure 10A:
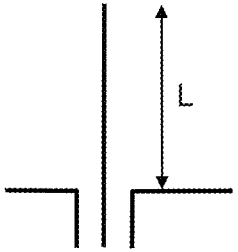

FIGS. 10*a*, 10*b* and 10*c* illustrate three different configurations of a monopole antenna arrangement having a same deployed length, according to some embodiments of the invention.

The length L of the deployed monopole of FIG. 10*a* is about 17.32 cm, which corresponds to a wavelength of the fundamental mode of 433 MHz.

The antenna of FIG. 10*b* has a same deployed length L as the antenna of FIG. 10*a*, but is folded in a zigzag form factor and is inscribed in a surface S of about $11\times2.2$ $cm^2$.

The antenna of FIG. 10*c* has a same deployed length L as the antenna of FIG. 10*a*, but comprises a first section 1010*c* that is rectilinear and vertical, a second section 1020*c* that is rectilinear and horizontal and a third section 1030*c* that is curvilinear and horizontal and forms a ring. The antenna arrangement is inscribed in a volume V of about $7\times3.5\times3.5$ $cm^3$.

It has been determined experimentally by the inventor that the Hot Spots and Cold Spots are essentially spaced by the same distances in the three different configurations. This is because the folding of the pole does not modify fundamentally the stationary regime which is established along the pole, be it rectilinear or folded. This is quite advantageous because a definite form factor can be adopted for a specific application without a need to recalculate the position of the leaves, thus allowing a reuse of the same design rules for various antenna arrangements. It should be noted though that the form factor of the pole will modify the resonating frequencies of the fundamental mode and the higher order modes. A man of ordinary skill may be able to measure the new resonating frequencies and/or to simulate them, using a simulation tool available on the market, such as CST™, HFSS™, Feko™ or Comsol™, or any other proprietary software.

FIGS. 11*a*, 11*b*, 11*c*, 11*d*, 11*e*, 11*f*, 11*g* and 11*h* illustrate different geometries of leaves and branches adapted for antenna arrangements according to the invention.

The number and positions of leaves that shift the frequencies of the harmonics having been determined, their form factors, dimensions and orientations have to be defined.

Figure 11A:
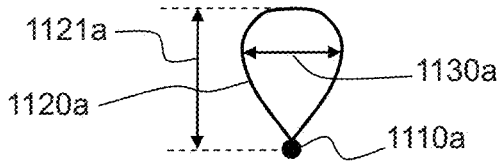
FIGS. 11*a*, 11*b*, 11*c*, 11*d*, 11*e*, 11*f*, 11*g* and 11*h* illustrate different geometries of leaves and branches adapted for antenna arrangements according to the invention.

As may be seen on FIG. 11*a*, a leaf has a point of connection 1110*a* to the trunk of the antenna arrangement. It has a maximum dimension 1120*a* between this point of connection and a distal extremity. Along a line connecting the point of connection and the distal extremity, a point 1121*a* defines a maximum width 1130*a* of the leaf.

Figure 11B:
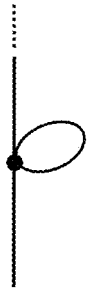
Figure 11C:
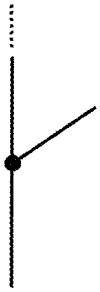

FIGS. 11*b* and 11*c* illustrate some aspects of the design rules to be used for determining the form factors of the leaves. On FIG. 11*c*, a simple rectilinear branch is displayed. On FIG. 11*b* is a leaf having about the same form factor as the one of FIG. 11*a*, the leaf having about the same impact on the shift in frequency of the antenna arrangement as the branch. The leaf has a maximum dimension which is preferably about half the length of the branch. It is therefore advantageous to use leaves instead of branches when compactness is an issue, that is to say in a significant number of cases. It is to be noted that branches and leaves have about a same impact on bandwidth and adaptation (or matching level).

Figure 11D:
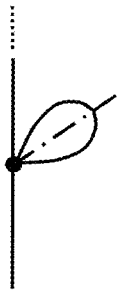
Figure 11E:
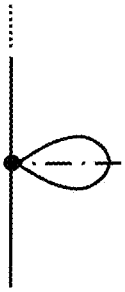
Figure 11F:
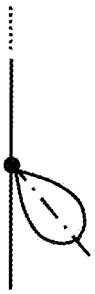

FIGS. 11*d*, 11*e* and 11*f* illustrate three different orientations of a same leaf relative to the trunk of the antenna arrangement. It has been determined experimentally by the inventor that the orientation of the leaf does not have a significant impact on the shift in frequency, adaptation or bandwidth of the antenna arrangement. It is preferable to avoid that the leaf becomes electrically coupled to the trunk. The minimum orientation to achieve this varies notably with the frequency to which the leaf is tuned. A preferred embodiment is therefore to select O so as the longer dimension D of the leaf is perpendicular to the tangent to the trunk at the point of attachment of the leaf to the trunk. In some other embodiments, where the minimum angle to the trunk to avoid coupling can be determined, by trial and error or by calculation means, this minimum angle will be preferably selected as orientation O of the leaf. A compromise between this minimum angle and an orientation perpendicular to the tangent to the trunk may also be preferable to take due account of the constraints on the global form factor of the antenna arrangement.

Figure 11G:
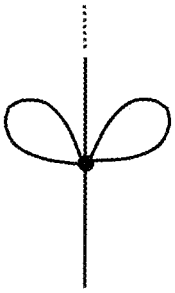
Figure 11H:
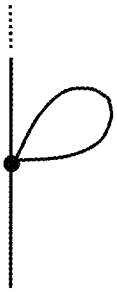

FIGS. 11*g* and 11*h* illustrate two different configurations of an antenna arrangement according to the invention. On FIG. 11*h* a large leaf is represented. On FIG. 11*g*, two small leaves having a same impact on the electrical parameters of the antenna are represented. Selecting this design is advantageous to achieve a more compact form factor.

Figure 12:
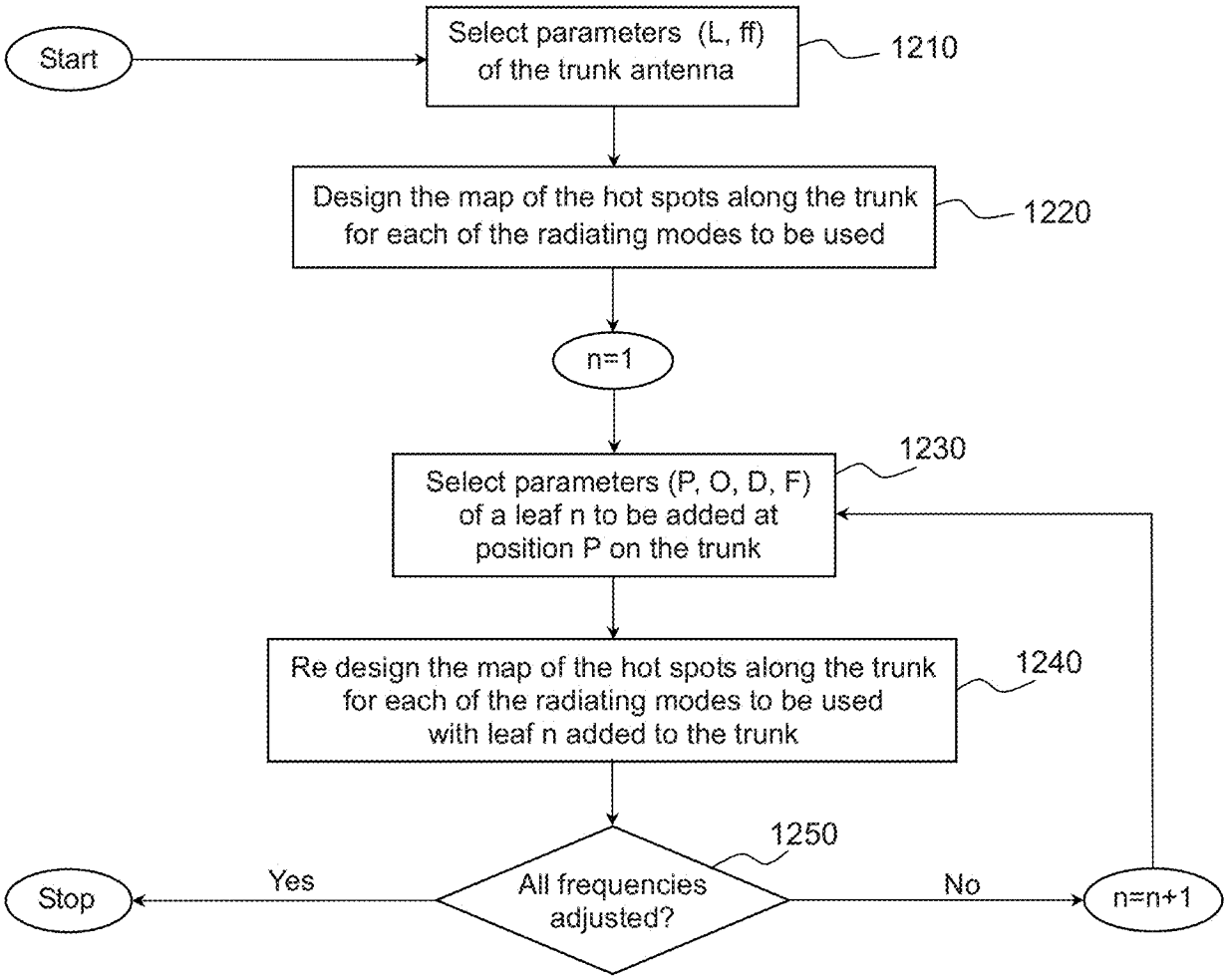
FIG. 12 displays a flow chart of a method to design antenna arrangements according to some embodiments of the invention.

FIG. 12 displays a flow chart of a method to design antenna arrangements according to some embodiments of the invention.

The selection of the design rules for a specific application may for example be organized as displayed on FIG. 12.

A first step 1210 of the process consists in selecting the deployed length L and the form factor ff of the wire/ribbon forming the trunk of the antenna arrangement. The frequency of the fundamental mode has to be selected at a value higher than or equal to the targeted lowest frequency, as already discussed above. The form factor to be selected depends on the target size of the antenna arrangement. Also the form factor of the pole may impact the antenna matching. But if the matching is adversely impacted by a specific pole form factor, it may be then corrected using an antenna matching technique. A man of ordinary skill will therefore be able to find an adequate compromise between the compactness form factor and the matching of the antenna arrangement. When the antenna arrangement is correctly matched (at a level better than −10 dB, for instance), the form factor of the trunk will have little impact on the available bandwidth.

Then, at a step 1220, the positions of the Hot Spots and Cold Spots along the pole for each radiating mode are calculated and/or represented on a map as explained above in relation to FIGS. 9*a*, 9*b*, 9*c* and 9*d* and with further details below in relation to FIGS. 13*a* and 13*b*.

Then, at a step 1230, the position P, orientation O, longer dimension D, form factor F (or second characteristic dimensions, as illustrated on FIG. 11*a*) have to be determined for a number of leaves n which is set on initialization at 1 and then iteratively increased by one unit until all the target frequencies have been obtained.

The first leaf (n=1) is placed so as to tune the frequency of the fundamental mode (if needed). There is only one single zone on the pole which is electrically sensitive for this mode. It is located close to the distal extremity of the pole which is in Open Circuit. There is therefore only one degree of freedom for this fundamental frequency. The parameters P, O, D, F should be selected so as to adjust a value of the frequency shift, $\Delta f=g(k,P,O,D,F)$. The amplitude of the frequency shift created by a leaf having defined parameters P, O, D and F will depend on the order k of the mode: the higher the order, the higher the variation of the frequency shift for a defined displacement of the leaf around a Hot Spot. O is selected based on the form factor of the trunk, to maximize compactness of the whole volume of the antenna arrangement, while minimizing electric coupling with the trunk. D and F are the main factors impacting Δf for a defined P at a defined order of the mode. Function g is used to create a "desired impact" of the P, O, D and F parameters on one or more of an antenna arrangement impedance, an antenna arrangement adaptation or a bandwidth of the electromagnetic radiation, once the radiating frequency itself has been tuned.

Parameters O, D and F can be set in whatever order, once the position P of the leaf has been determined.

If this leaf is placed close to positions which are Hot Spots for other modes, the radiating frequencies of these other modes will also be shifted. The magnitude of the shift may depend on the position of this leaf relative to the Hot Spot positions for these other modes.

At step 1240, the map of Hot Spots and Cold spots is redesigned after leaf n has been added with the same process.

At step 1250, whether all frequencies have been adjusted to their target values or not is tested. If so, the process stops and the design rules are complete. If not, a leaf n+1 should be added to adjust the frequency of a higher order mode. A new leaf is added at a position P that is a Hot Spot for this mode and a Cold Spot for a lower order mode which was previously adjusted. As discussed earlier, higher order modes have a higher number of Hot Spots and hence have a higher number of degrees of freedom.

Figure 13A:
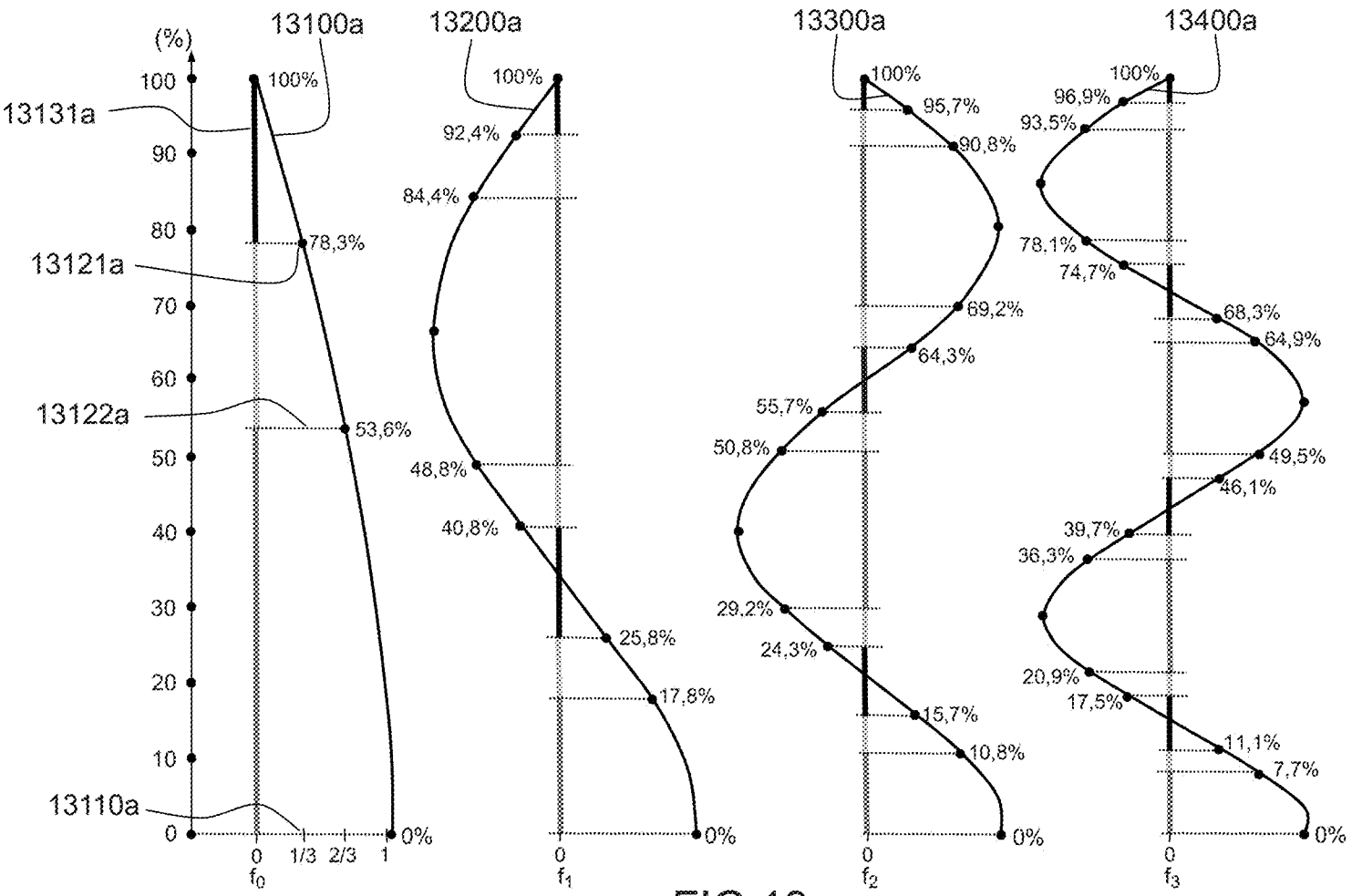
FIGS. 13*a* and 13*b* represent diagrams respectively of the magnetic field and the electric field in the fundamental mode and the $1^{st}$ to $3^{rd}$ higher order modes for an antenna arrangement according to the invention.
Figure 13B:
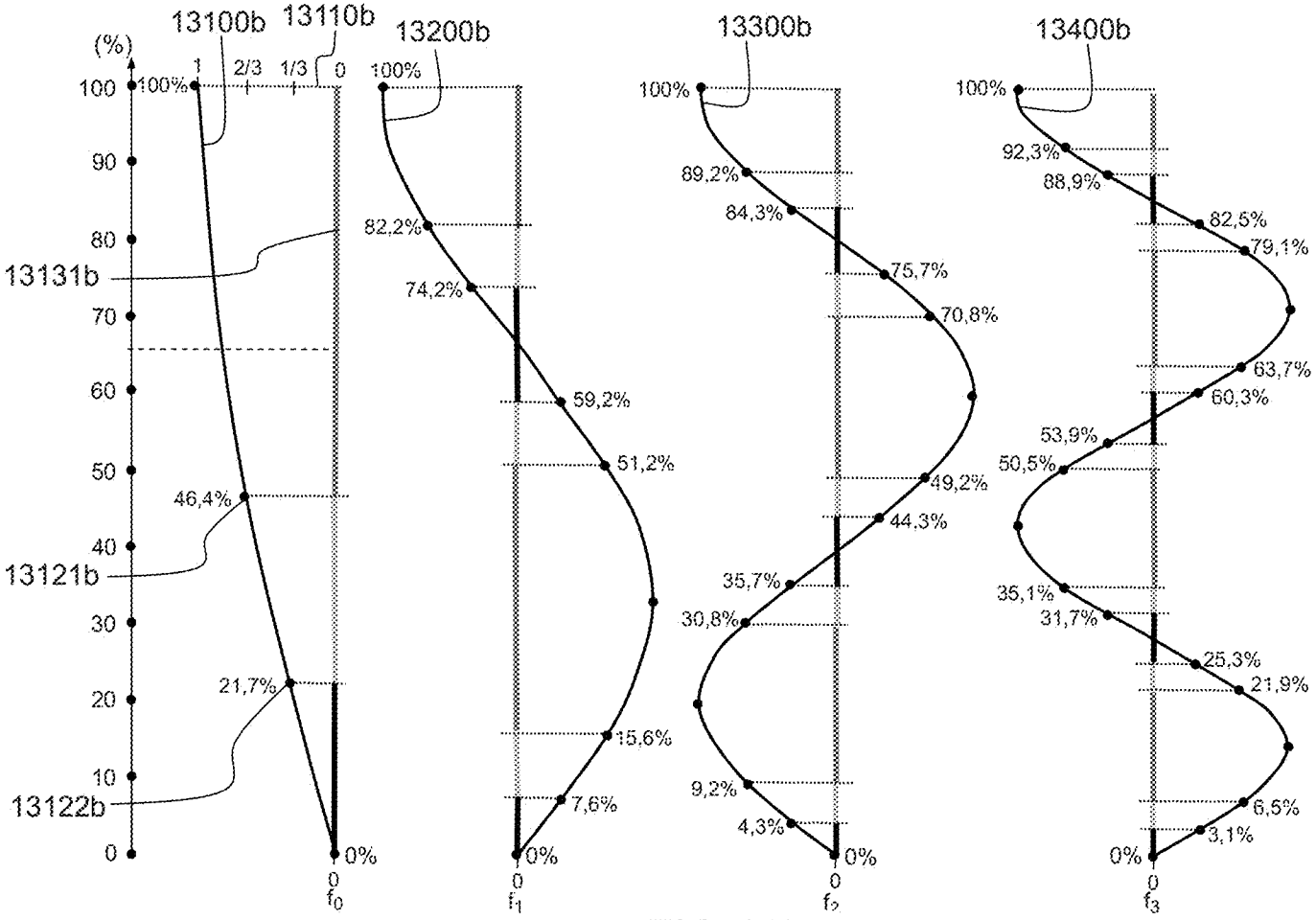

FIGS. 13*a* and 13*b* represent diagrams respectively of the magnetic field and the electric field in the fundamental mode and the $1^{st}$ to $3^{rd}$ higher order modes for an antenna arrangement according to the invention.

These figures represent a map of the Hot Spots and Cold Spots, the principles of which have already been explained above notably in relation to FIGS. 9*a* to 9*j*.

Comments will be provided in relation to FIG. 13*b* which is analogous to a map of the electric voltage. Four modes are represented by curves 13100*b*, 13200*b*, 13300*b* and 13400*b*. By way of example only, the abscissa represents the amplitude of the field, with cut-off values at ⅓ of the amplitude, ⅔ of the amplitude and 100% of the amplitude (scale 13110*b*). Other cut-off values could be selected without departing from the scope of the invention. The ordinate represents the percentage of the length of the deployed trunk element of the antenna arrangement. Ordinates corresponding to the cut-off values are indicated on the curves at points 13121*b*, 13122*b*, etc. The areas around the Hot Spots corresponding to the cut-off values are marked along the pole, 13131*b*. While they are only designated by reference numerals for the fundamental mode $f_0$ for the sake of readability of the figure, it can be easily understood that the corresponding values and marks have the same meaning for the higher order modes. The areas marked as corresponding to ⅔ to 100% of the amplitude are the areas for which a variation of the position of the leaves will have a significant impact on the shift in frequency, a variation of the position of the leaves having a limited impact or no impact at all on the shift in frequency in the other areas. Areas included within the proximal cut-off values of a Hot Spot will be designated as being "near" the position of this Hot Spot. By way of example only, for the fundamental frequency, the area where a variation of the position of the leaf will have a significant impact on the shift in frequency is located between the top of the pole and a position corresponding to an intensity of ⅔ of the maximum amplitude, that corresponds to amplitude value 13121*b* that equals 46.4% of the total length L of the pole, starting from the ground plane. This area may be designated as a hot area. From this position down to a position corresponding to 21.7% of L and to ⅓ of the amplitude, a variation of the position of a leaf will have limited impact on the shift in frequency. This area may be designated as a "tepid area". From this last position to the ground plane, a variation of the position of a leaf will have no impact on the shift in frequency. This area may be designated as a cold area. Similar comments and reasoning apply to the spots placed for the other higher order modes represented by curves 13200*b*, 13300*b* and 13400*b*.

The map of FIG. 13*b* allows placing the leaves according to the method described above in relation to FIG. 12.

FIG. 14 represents a table of electric sensitivities along the antenna in the fundamental mode and the $1^{st}$ to $3^{rd}$ higher order modes for an antenna arrangement according to the invention.

The figure includes two tables 14100 and 14200.

Table 14100 represents with different symbols 14121, 14122, 14123 the spots along the pole that belong respectively to a hot area, a tepid area and a cold area. The representation includes a scale 14100 graduated, by way of example only, every 5% of the length L of the deployed pole. On the scale for the fundamental mode, there is only one symbol, whereas for the higher order modes, there are two symbols. The two symbols illustrate the fact that the marked spot is in-between two areas for this mode.

Table 14200 represents a conversion of the symbols of table 14100 into an index of sensitivity of the shift in frequency for the mode to a variation of the position of a leaf. By way of example only, the index is chosen on a scale from 0 to 6. But another scale may be chosen without departing from the scope of the invention. Table 14300 displays the rule of conversion chosen in this example. But other rules of conversion may be chosen. Table 14200 allows to get a clear view of the impact of variations in positions of the leaves along the pole for all the frequencies.

In some embodiments of the invention, variables defining a rate of impact of a position of a leaf for each mode may be determined and a function defining the combination of at least some, if not all, the variables may also be determined using calculation, simulation or abaci.

Figures 15, 16:
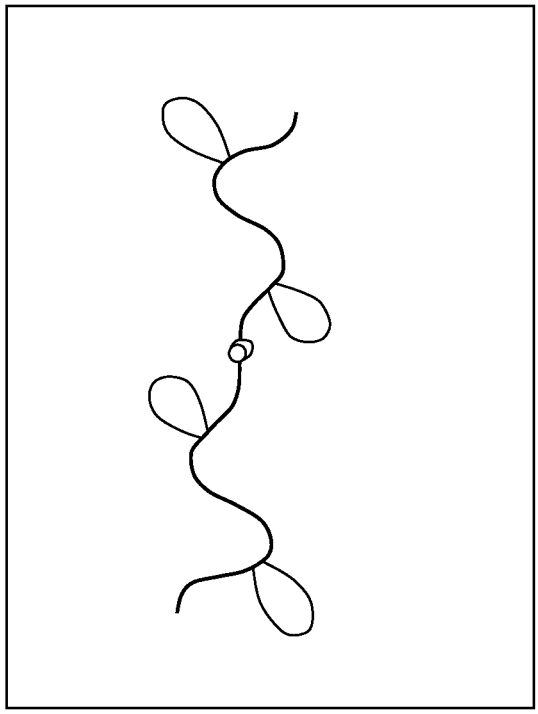
FIG. 15 represents a table to assist in the selection of the positioning of the leaves to adjust the values of some frequencies selected among the fundamental mode and the $1^{st}$ to $3^{rd}$ higher order modes for an antenna arrangement according to the invention.
FIG. 16 represents a dipole antenna arrangement according to some embodiments of the invention.

FIG. 15 represents a table to assist in the selection of the positioning of the leaves to adjust the values of some frequencies selected among the fundamental mode and the $1^{st}$ to $3^{rd}$ harmonic modes for an antenna arrangement according to the invention.

From table 14200 of FIG. 14, it is possible to determine which frequencies the position of a leaf will impact or not impact. For instance, a leaf placed at 85% of the length L of the pole will impact modes $f_0$ and $f_1$, whereas a leaf placed at 60% of L will impact modes $f_0$ and $f_2$.

It is thus possible, according to the invention, to define placement rules of the leaves using the method described above in relation to FIG. 12.

The invention may be applied to antenna arrangements which radiate in different frequency domains and are used for very different applications.

The invention may also be applied to dipole antennas, as can be seen from the example of FIG. 16. A dipole antenna is a two poles antenna where the two poles are excited by a differential generator. The two poles of the dipole antenna will each operate with stationary regimes which have the same behavior. According to the invention, the two pole antennas will preferably have the same functions g defined above. The Hot Spots and Cold Spots will be located at a same distance from the feed. In this case, the leaves located on each pole will be symmetric (same distance from the electrical connection), have same form factors, lengths and orientations. In this mode, displacements of two symmetric leaves will generate a same elementary shift in frequency.

The examples disclosed in this specification are therefore only illustrative of some embodiments of the invention. They do not in any manner limit the scope of said invention which is defined by the appended claims.

The invention claimed is:

1. An antenna arrangement comprising:

a first conductive element configured to radiate above a defined frequency of electromagnetic radiation;

one or more additional conductive elements located substantially on one or more positions defined as a function of positions of nodes of current of electromagnetic radiation of selected harmonics of the electromagnetic radiation.

2. The antenna arrangement of claim 1, wherein a distance of the one or more positions in relation to the positions of nodes is defined based on an influence of said one or more additional conductive elements on values of the radiated frequencies of the electromagnetic radiation.

3. The antenna arrangement of claim 2, wherein frequency shifts imparted by the additional conductive elements define a set of predefined radiation frequencies for the antenna arrangement.

4. The antenna arrangement of claim 1, wherein one or more of a number, a first dimension, a form factor, or an orientation of the one or more additional conductive elements are defined based on a desired impact on a frequency shift of one or more of a fundamental mode or a higher order mode of electromagnetic radiation.

5. The antenna arrangement of claim 4, wherein the one or more of a number, a first dimension, a form factor, or an orientation of the one or more additional conductive elements are further defined as a function of a desired impact on one or more of an antenna arrangement impedance, an antenna arrangement matching level or a bandwidth of the electromagnetic radiation.

6. The antenna arrangement of claim 1, wherein the first conductive element is a metallic ribbon and/or a metallic wire.

7. The antenna arrangement of claim 1, wherein the first conductive element has one of a 2D or 3D compact form factor.

8. The antenna arrangement of claim 7, deposited by a metallization process on a non-conductive substrate layered with one of a polymer, a ceramic or a paper substrate.

9. The antenna arrangement of claim 1, tuned to radiate in two or more frequency bands, comprising one or more of an ISM band, a WIFi band, a Bluetooth band, a 3G band, an LTE band and a 5G band.

10. The antenna arrangement of claim 1, wherein the first conductive element is a monopole or a dipole antenna.

11. A method of designing an antenna arrangement comprising:—defining a geometry of a first conductive element to radiate above a defined frequency of electromagnetic radiation—locating one or more additional conductive elements at or near one or more positions defined as a function of positions of nodes of current of electromagnetic radiation of selected harmonics of the electromagnetic radiation.

12. The method of claim 11, wherein the locating the one or more additional conductive elements at or near one or more the defined positions is performed by starting from a fundamental mode and iterating in increasing order of the harmonics.

13. The method of claim 12, wherein the locating the one or more additional conductive elements at or near one or more the defined positions is performed based on a map of one or more of hot areas, tepid areas or cold areas by selecting positions which impact the less on modes which have already been tuned.

14. The method of claim 11, further comprising defining one or more of a number, a first dimension, a form factor, or an orientation of the one or more additional conductive elements based on a desired impact on a frequency shift of one or more of a fundamental mode or a higher order mode of electromagnetic radiation.

15. The method of claim 14, wherein the defining one or more of a number, a first dimension, a form factor, or an orientation of the one or more additional conductive elements is further based on a desired impact on one or more of an antenna arrangement impedance, an antenna arrangement matching level or a bandwidth of the electromagnetic radiation.

* * * * *